US012631330B1

(12) United States Patent
Rudell

(10) Patent No.: US 12,631,330 B1
(45) Date of Patent: May 19, 2026

(54) BURNER BLOCK ASSEMBLY FOR AN INDUSTRIAL FURNACE

(71) Applicant: Rodney W. Rudell, Pearland, TX (US)

(72) Inventor: Rodney W. Rudell, Pearland, TX (US)

( * ) Notice: Subject to any disclaimer, the term of this patent is extended or adjusted under 35 U.S.C. 154(b) by 0 days.

(21) Appl. No.: 19/056,640

(22) Filed: Feb. 18, 2025

Related U.S. Application Data

(63) Continuation of application No. 18/749,532, filed on Jun. 20, 2024, now Pat. No. 12,259,131.

(51) Int. Cl.
*F23M 5/02* (2006.01)

(52) U.S. Cl.
CPC ..... *F23M 5/025* (2013.01)

(58) Field of Classification Search
None
See application file for complete search history.

(56) References Cited

U.S. PATENT DOCUMENTS

| | | | | |
|---|---|---|---|---|
| 2,339,477 | A * | 1/1944 | Hess | F23D 14/125 D23/385 |
| 4,400,151 | A | 8/1983 | Vatsky | |
| 9,915,476 | B2 | 3/2018 | Chao | |
| 10,174,945 | B2 * | 1/2019 | Schalles | F27D 99/0033 |
| 10,204,806 | B2 * | 2/2019 | Emami | H01L 21/67109 |
| 10,605,456 | B2 | 3/2020 | Russell et al. | |
| 11,027,251 | B2 | 6/2021 | Russell et al. | |

FOREIGN PATENT DOCUMENTS

| | | | | |
|---|---|---|---|---|
| CN | 1969163 | B * | 9/2010 | F27D 1/0006 |
| CN | 203216275 | U | 9/2013 | |
| CN | 2099099040 | U | 1/2020 | |
| CN | 219083079 | U | 5/2023 | |
| KR | 200168538 | | 2/2000 | |
| WO | 8400176 | A1 | 1/1984 | |

* cited by examiner

*Primary Examiner* — Jason Lau
(74) *Attorney, Agent, or Firm* — Lloyd & Mousilli, PLLC; Feras Mousilli; Benjamin M. Hanrahan

(57) ABSTRACT

An industrial furnace burner block assembly is presented herein. The assembly includes a mounting plate defining a fire tube extending there from. A plurality of tabs extend from the mounting plate and engage a corresponding groove or slot formed on a refractory burner block. The burner block includes four block sections that each allow for independent thermal growth during operation. The burner block also defines a center aperture collectively formed by corresponding internal surfaces of the independent block sections. A sealing ring is mounted within a groove in the burner aperture and is disposed in a sealing relation with an external surface of the firing tube. A tongue-and-groove connection assembly is formed on mating surfaces between adjacent burner block sections. The tongue-and-groove connection assembly and the sealing ring each provide a gas-tight seal that restricts gas bypassing.

9 Claims, 7 Drawing Sheets

BURNER BLOCK ASSEMBLY FOR AN INDUSTRIAL FURNACE

CLAIM OF PRIORITY/CROSS-REFERENCE TO RELATED APPLICATION

The present application is a Continuation Patent Application of U.S. patent application Ser. No. 18/749,532 filed on Jun. 20, 2024, the contents of which are incorporated in its entirety by reference.

FIELD OF THE INVENTION

The present invention is generally directed to a burner block assembly, and more specifically, an industrial furnace burner block or burner tile that includes a plurality of separate and independent block sections that are each capable of independent thermal growth or expansion.

BACKGROUND OF THE INVENTION

In particular, burner blocks (sometimes also referred to as burner tiles or burner quarls) are used in high-temperature industrial furnaces, kilns, incinerators, reactors, etc. (collectively referred to as a furnace or furnaces) and operate to provide heat to the furnace. As just an example, industrial furnaces can be used in several different applications, industries or locations, including but in no way limited to oil or other refining, petrochemical plants, achieving desired chemical reactions, glasswork, metal or other forging, for example by melting glass or metal, firing ceramics, burning trash, etc.

Moreover, industrial furnace designs can vary depending on the particular intended function, heating duty, type of fuel used, etc., although in many instances, the burner block contains a cavity or aperture that extends through the block where a fuel (e.g., gas or natural gas) and/or an oxidant may be supplied at one end of the cavity or aperture while the combustion, heat or ignition passes through the other end of the cavity or aperture (at a hot end of the burner block) and into the combustion zone of the furnace.

Furthermore, in order to achieve the desired goal or intended operation (e.g., oil refining, chemical reactions, melting glass or metal, etc.) an industrial furnace must often reach temperatures as high as four hundred degrees Celsius or more. Accordingly, the components of the furnace, including the burner block, must be able to withstand extremely high temperatures in order to continue to operate in their intended fashion. In this manner, the burner block is often constructed of a refractory material that is resistant to the high temperatures generated in the furnace, and can include, for example, a ceramic or other type of material that may be resistant to thermal shock, may be chemically inert, may have particular ranges of thermal conductivity and thermal expansion.

Nevertheless, in operation, sometimes quickly and sometimes over extended use, burner blocks often develop cracks, fractures, or other failures, commonly due to the high temperatures and/or chemical reactions operating within the furnace, and/or due to the thermal expansion of the burner block that is an inevitable result of the environment. Once the burner block develops even a small crack, fracture or other failure, the burner block will fail to provide effective separation of the combustion zone from other spaces, may fail to properly define the flame or combustion, may fail to provide adequate insulation of the surrounding environment from the heat developed in the combustion zone, etc. Also, once a failure develops in the burner block, the failure will often rapidly spread or worsen, requiring immediate attention, usually replacement.

In addition, stresses from the burner block can be transferred to the mounting structure upon which the burner block is attached, which can lead to warping or other failure of the mounting structure(s) or other components that are collectively to operate the burner block in the furnace. Warping of the mounting structure or other like components can then lead to other complications, including, for example, gas bypassing on the shell or mounting structure.

There is, thus, a need in the art for a new and/or an improved burner block that can operate in high-temperature environments, accommodate inevitable thermal expansion and minimize premature failures.

SUMMARY OF THE INVENTION

Accordingly, the present invention is generally directed to an industrial furnace burner block or burner tile that includes a plurality of separate and independent block sections that are each capable of independent thermal growth or expansion.

More specifically, the assembly includes a mounting plate defining a first surface and an opposing second surface. A fire tube or burner port extends from the first surface of the mounting plate and provides an aperture or cavity though which combustion or ignition takes place.

Furthermore, the mounting plate includes an attachment assembly which, in at least one embodiment, incudes at least one, although more practically a plurality of clips or tabs that extend upward and/or outward from the first surface of the mounting plate. At the distal end of each tab or clip is an angled finger projection that engages with a corresponding groove or slot formed on the refractory burner block, as disclosed herein.

For instance, the assembly of the various embodiments of the present invention also include a burner block, formed of a refractory material, that is mounted to the mounting plate via the attachment assembly and/or the clips or tbs thereof. More in particular, however, the burner block of at least one embodiment includes at least two, and in some embodiments four independent block sections, each forming a separate quadrant of the burner block. As provided above, each of the refractory burner block sections are formed with an external attachment groove disposed an external surface, within which the clips or tabs of the attachment assembly attach.

Furthermore, the refractory burner block also defines an aperture which is collectively formed by corresponding internal surfaces of the plurality of independent block sections or quadrants. The burner block aperture surrounds the fire tube extending from the mounting plate.

In order to minimize, reduce or in some cases eliminate gas bypassing between the burner block and the firing tube toward the mounting plate, in at least one embodiment, a sealing ring or sealing member is mounted within the burner aperture and is disposed in a sealing relation with an external surface of the firing tube. More specifically, each of the plurality of burner block sections of at least one embodiment include a groove disposed on the internal surfaces that form the burner aperture. The sealing member or sealing ring is seated at least partially within the grooves and extends to the external surface of the firing tube where it forms a sealing engagement therewith.

Additionally, the assembly of at least one embodiment also includes a tongue-and-groove connection assembly formed on mating surfaces between adjacent burner block sections. More specifically, one of the surfaces of adjacent burner blocks includes a tongue, while the other surface includes a corresponding groove within which the tongue fits.

The tongue-and-groove connection assembly between adjacent burner block sections provides a seal or connection that restricts and in some cases prevents gas bypassing between the adjacent burner block sections, even in the event the burner tip is firing directly onto a quadrant or section with flame impingement.

Moreover, the multi-block design of at least one embodiment of the present invention allows for the independent thermal growth of each block section. In other words, one block section may thermally expand or grow at a different rate or impact than another one of the block sections of the same burner block. This reduces internal mechanical stresses, prevents or minimizes cracking of refractory shapes, reduces stress on the clips or tabs, and in turn, reduces or eliminates warping of the mounting plate.

BRIEF DESCRIPTION OF DRAWINGS

Like reference numerals refer to like parts throughout the several views of the drawings provided herein.

DETAILED DESCRIPTION OF THE INVENTION

Figure 1:
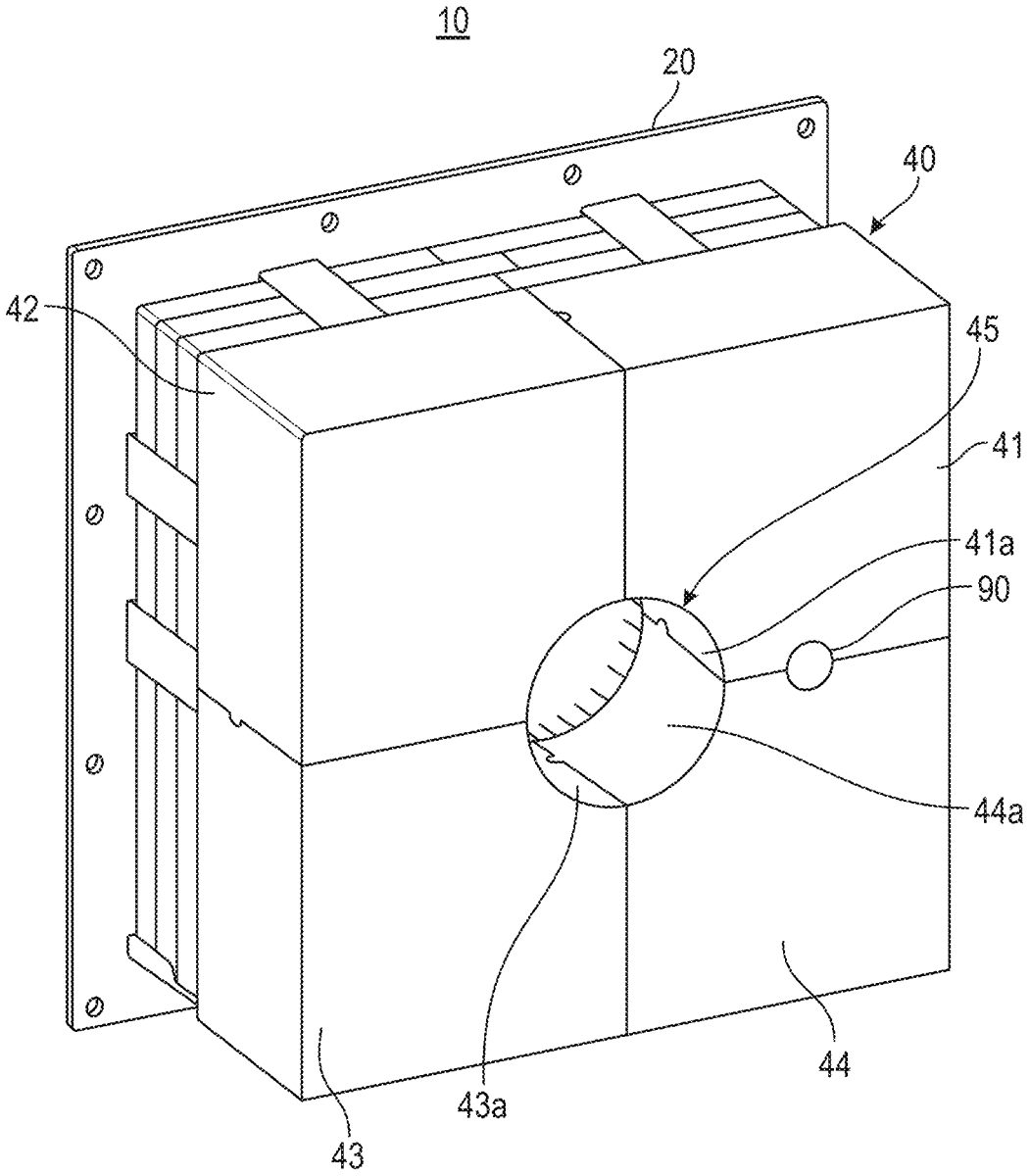
FIG. 1 is a front perspective view of the burner block assembly as disclosed in at least one embodiment of the present invention.

As shown in the accompanying drawings, and with particular reference to FIG. 1, at least one embodiment of the present invention is generally directed to a burner block assembly (sometimes also referred to as a burner tile or burner quarl), referenced as 10 throughout the figures, that is configured for use in high-temperature industrial furnaces, kilns, incinerators, reactors, etc. (collectively referred to herein as a furnace or furnaces.)

In particular, the burner block assembly 10 of at least one embodiment of the present invention includes a mounting plate or base 20, upon which the burner block 40 is mounted, either directly or indirectly. The mounting plate 20 of at least one embodiment may be constructed of carbon steel or other rigid, durable material that is able to withstand the high temperatures of the furnace and environment.

Moreover, the mounting plate 20 includes a first surface 22*a* and a second surface 22*b*. The first surface 22*a*, in some instances, faces towards the combustion chamber of the furnace (not shown), while the second surface 22*b* faces away from the combustion chamber. In this manner, the first and second surfaces 22*a*, 22*b* are opposite one another, and as shown the exemplary embodiment of the drawings (e.g., with reference to FIGS. 1 and 5), may include generally flat or planar surfaces. It should be noted, however, that in other embodiments, one or both of the opposing first and second surfaces 22*a*, 22*b* of the mounting plate 20 may be non-planar, for example, with one or more curves, contours, angles, steps, etc.

Figure 2:
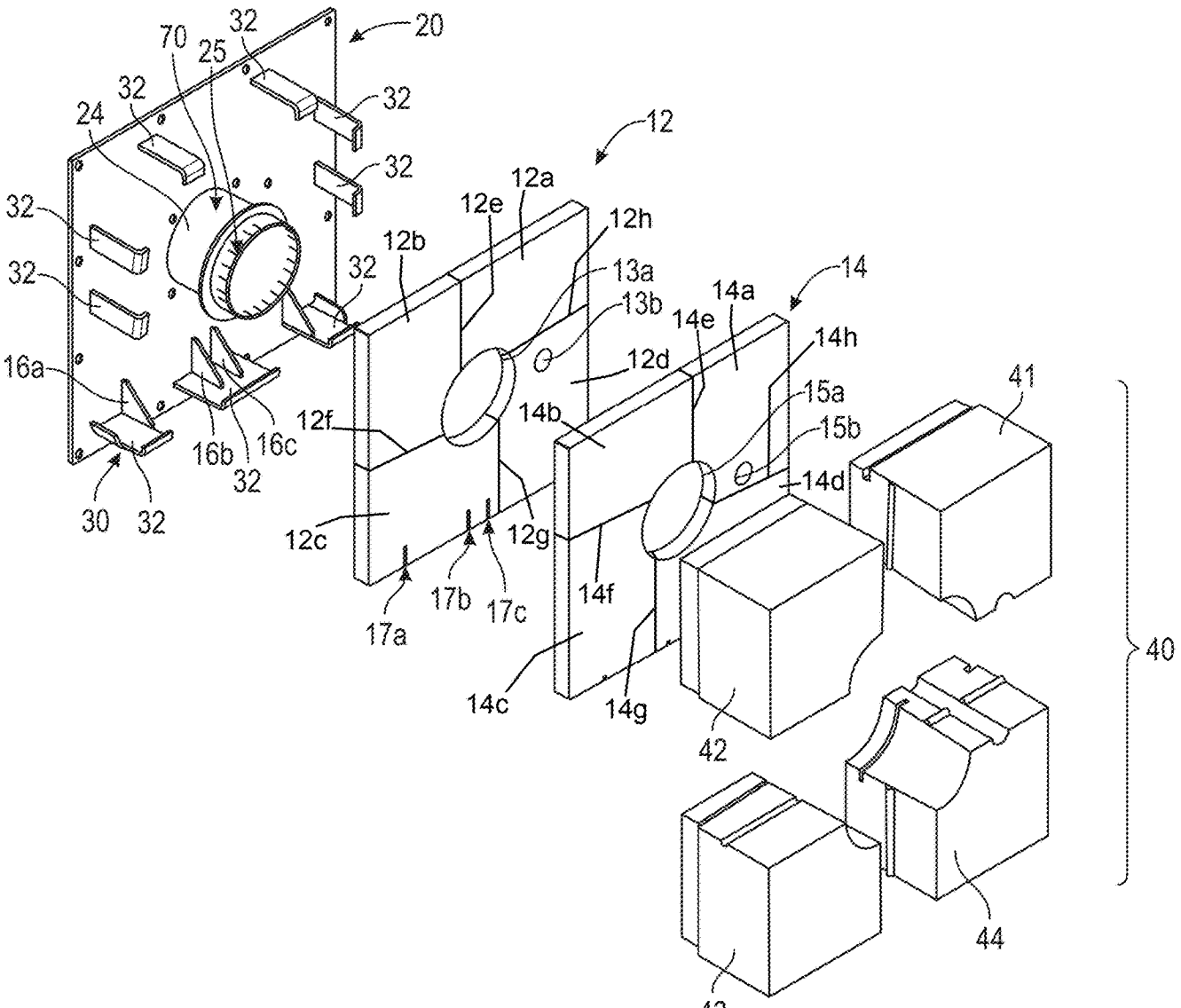
FIG. 2 is an exploded perspective view of the burner block assembly illustrated in FIG. 1.
Figure 5:
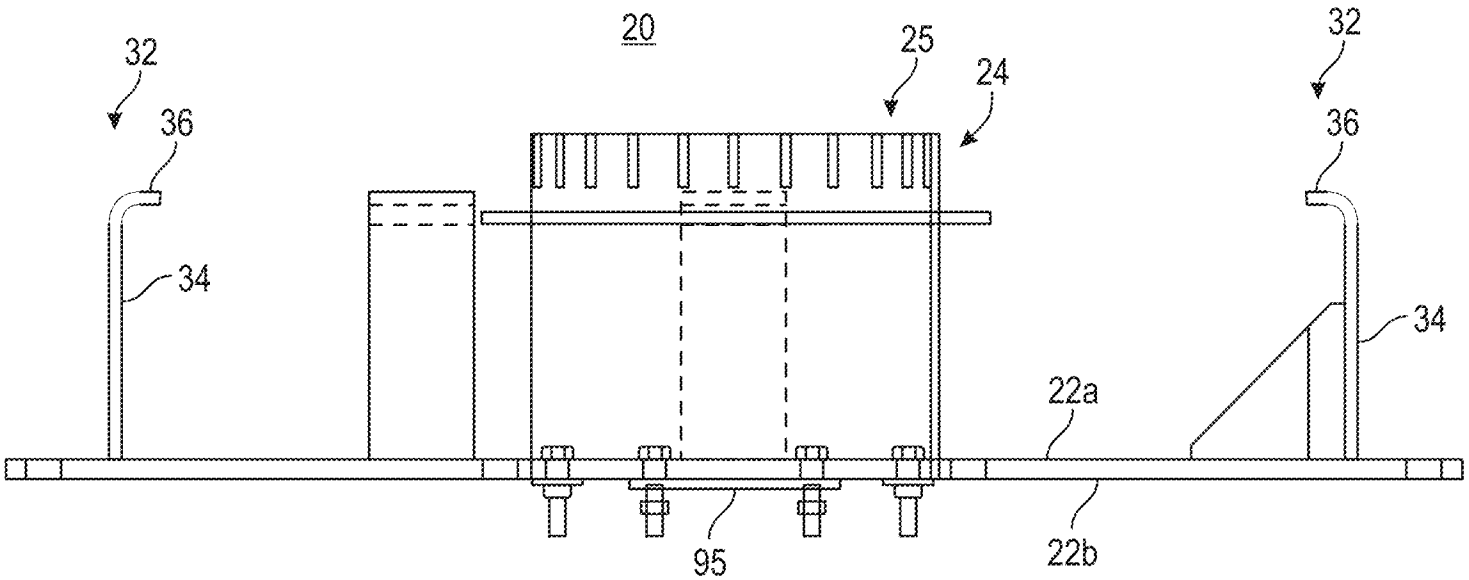
FIG. 5 is a side elevation view of the mounting plate as disclosed in accordance with at least one embodiment of the present invention.

With reference now to FIGS. 2 and 5, the mounting plate 20, of at least one embodiment, also includes a burner port or firing tube 24 that extends from the first surface 22*a* or other surface of the mounting plate 20. More in particular, the burner port or firing tube 24 defines an aperture or internal cavity 25 that passes through the burner port 24 and terminates at opposing open ends 25*a*, 25*b*. A fuel (e.g., gas or natural gas) and/or an oxidant may be supplied at one end 25*b* of the cavity or aperture 25 while the combustion, heat or ignition passes through the other end 25*a* of the cavity or aperture 25 (e.g., at a hot end of the burner block 40) and into the combustion zone of the furnace (not shown).

Furthermore, as shown in FIGS. 1, 2, 5 and 7, the mounting plate 20 of at least one embodiment also includes an attachment assembly 30 that is used to mount or attach a burner block 40 thereto, as discussed herein. The attachment assembly 30 and/or at least a portion of the attachment assembly 30 may be fixed or otherwise connected, either movably, removably or non-movably, to the mounting plate 20 and, in at least one embodiment, extends from (e.g., upward or outward from) the first surface 22*a* thereof.

In particular, the attachment assembly 30, of at least one embodiment, includes at least one, although in many embodiments a plurality of extensions, tabs or clips, referenced as 32 extending from the mounting plate 20, e.g., from the first surface 22*a* thereof, and are attachable to the burner block 40. In some cases, at least one or all of the clips, tabs or extensions 32 may include an arm 34 that attaches at one end to the mounting plate 20 and which include an angled projection 36 or mounting finger at the other, distal end. As will be described herein, the angled projection 36 of the clip or extension 32 will attach or engage to a corresponding groove 71-74 or other like structure, mechanism or component of the burner block 40.

With reference now to FIG. 5, at least one or all of the tabs or clips 32 of the attachment assembly 30, and in particular the arms 34 thereof, may be orthogonal or perpendicular, or substantially orthogonal or perpendicular to the first surface 22*a* of the mounting plate 20, although other configurations are contemplated within the full spirit and scope of the present invention.

Referring again to FIG. 1, as well as FIGS. 2-5, a burner block 40 is mounted to the mounting plate 20 via the attachment assembly 30. As provided above, the burner block 40 may be constructed of a refractory material that is resistant to the high temperatures generated in the furnace, and can include a material that is resistant to thermal shock, may be chemically inert, and may have particular ranges of thermal conductivity and thermal expansion.

In any event, the burner block 40 of at least one embodiment includes a plurality of block sections, referenced as 41, 42, 43, 44 in the exemplary embodiment shown in the figures, each of which mate with or against one or more adjacent block sections to collectively define the burner block 40.

More specifically, in at least one embodiment, each of the block sections 41, 42, 43, 44 include an internal surface 41*a*, 42*a*, 43*a*, 44*a* or an inside-facing surface that defines a portion of a burner block aperture 45. The burner block aperture 45 is an opening or hole through the burner block 40, sometimes although not always, through the center of the burner block 40, and corresponds with or communicates with the burner port or firing tube 24, and in particular, the aperture 25 thereof. In some embodiments, the burner block aperture 45 is disposed in a surrounding relation to the firing tube 24.

Figure 3:
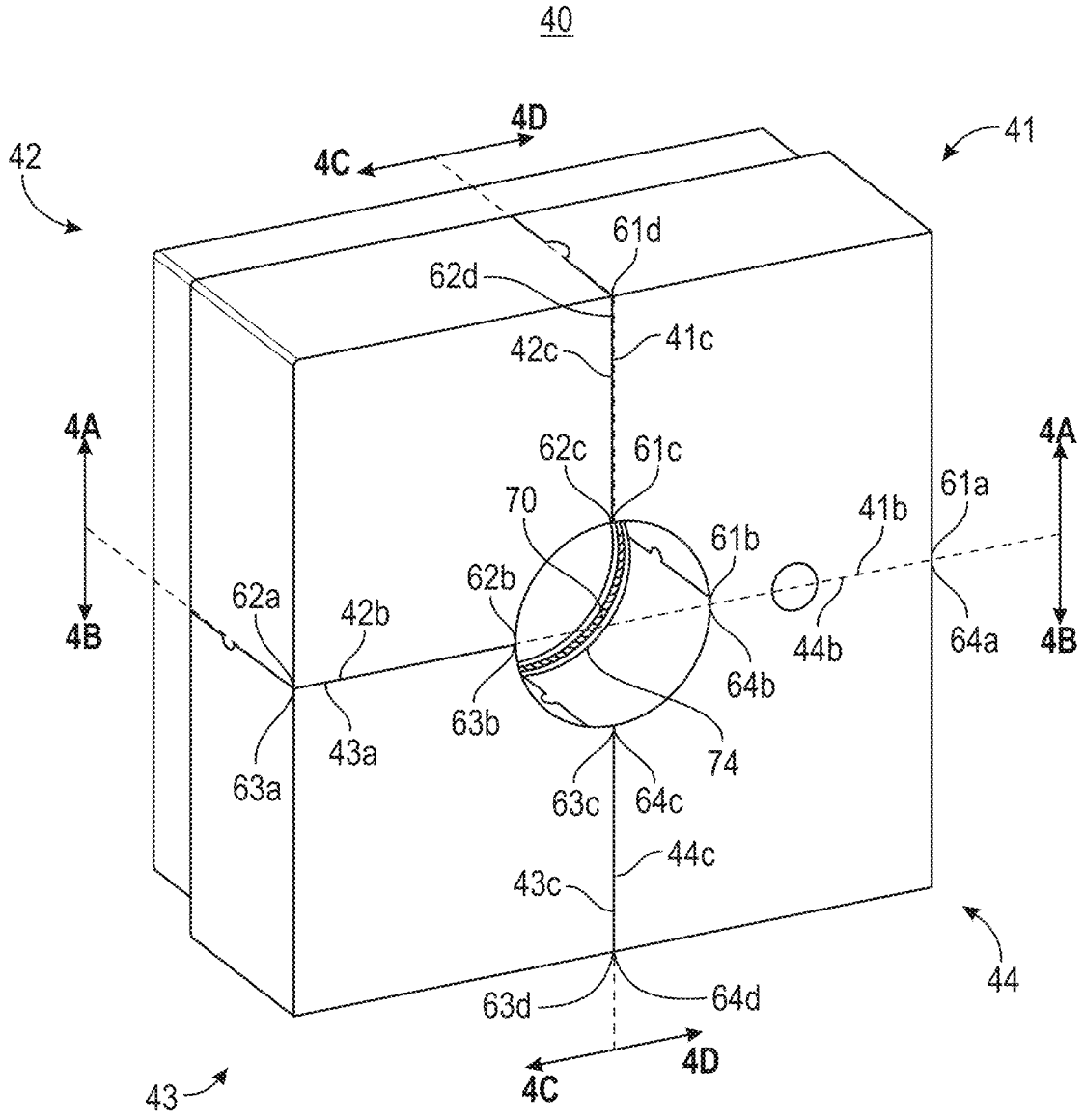
FIG. 3 is a perspective view of the refractory burner block as disclosed in accordance with at least one embodiment of the present invention.

Furthermore, with reference to FIGS. 1-3, the internal surfaces 41*a*, 42*a*, 43*a*, 44*a* in the embodiment shown are curved or rounded such that collectively, the internal surfaces 41*a*, 42*a*, 43*a*, 44*a* define a circular aperture 45. However, other embodiments are not limited to such a shape or configuration in that that aperture 45 may be virtually any shape including oval or elliptical, square, rectangular, or other polygon or shape.

Moreover, each of the block sections 41-44 include at least one, although more commonly, two mating surfaces that face, engage or mate against corresponding mating surfaces of an adjacently disposed block section.

Figure 4A:
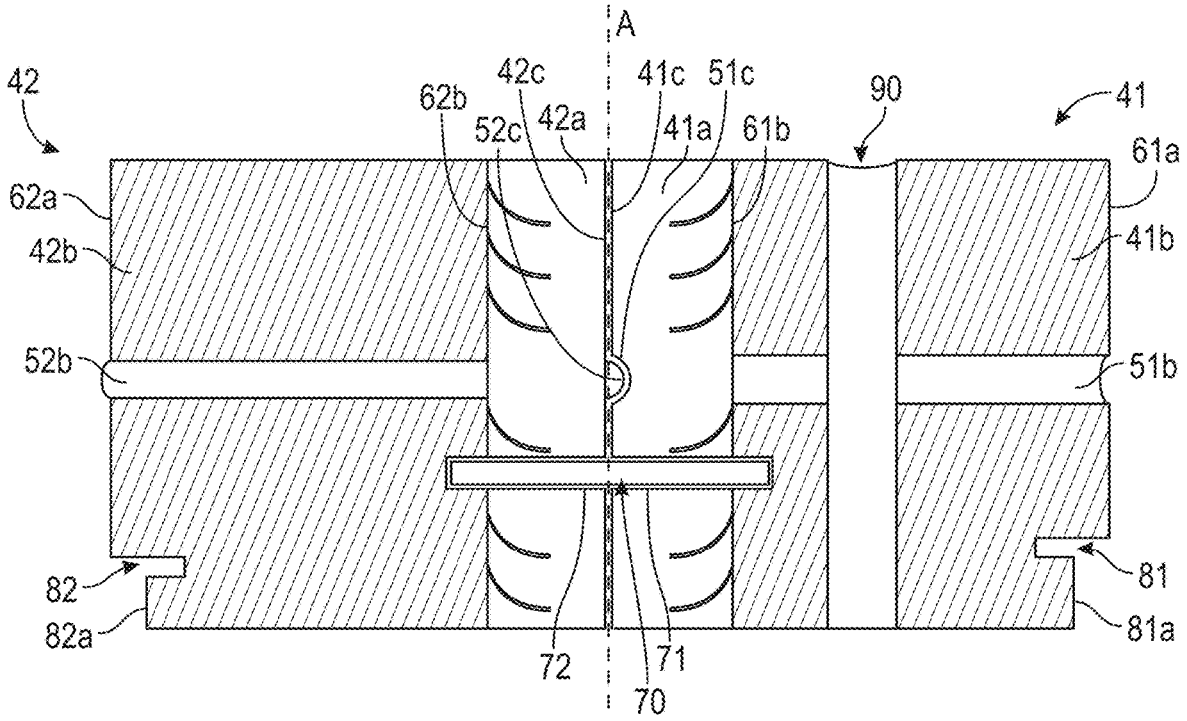
FIG. 4A is a cross-sectional view of the refractory burner block along line 4A-4A shown in FIG. 3.
Figure 4B:
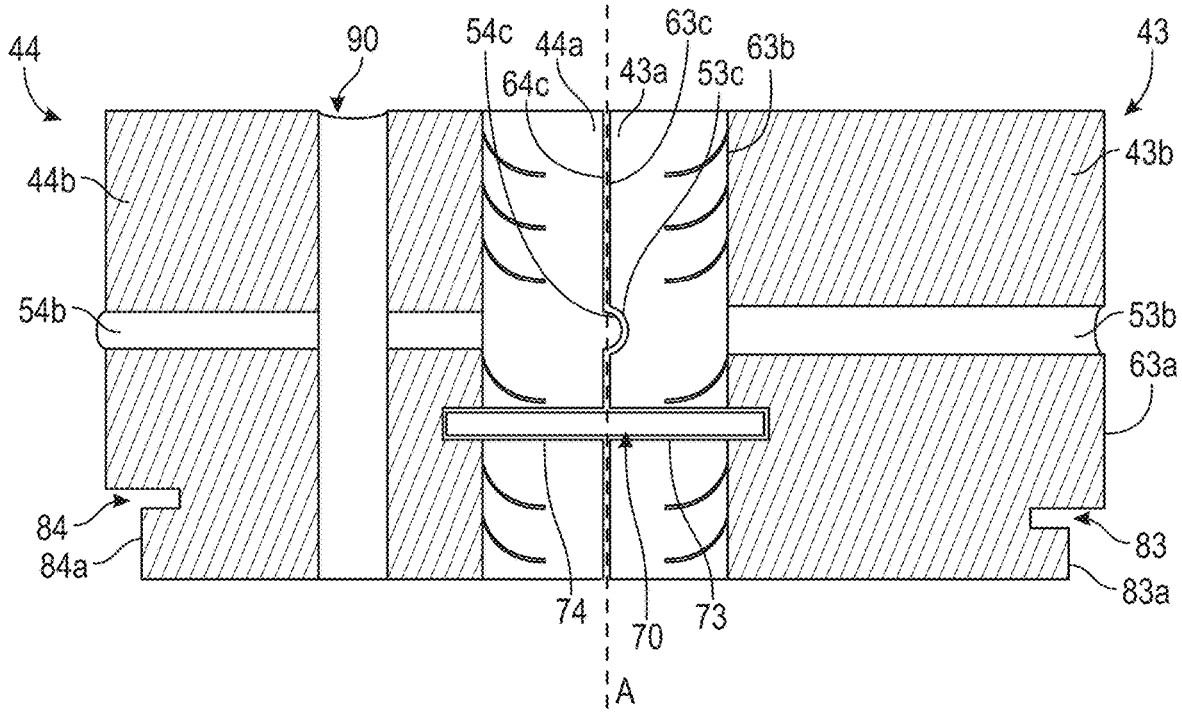
FIG. 4B is a cross-sectional view of the refractory burner block along line 4B-4B shown in FIG. 3.
Figure 4C:
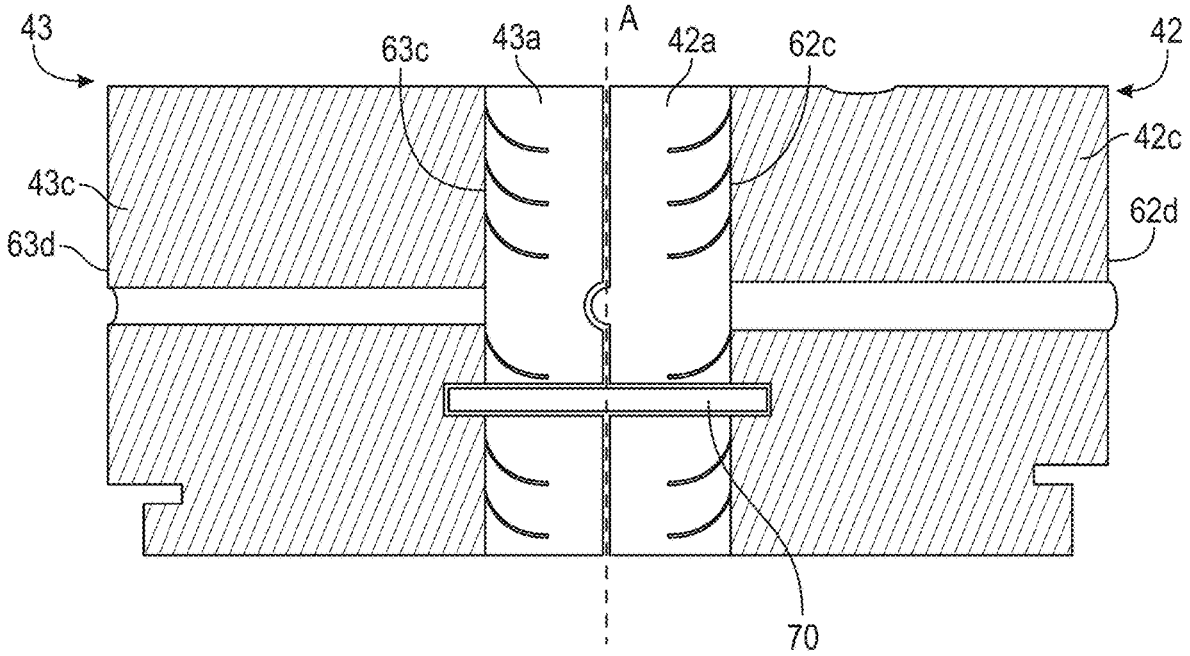
FIG. 4C is a cross-sectional view of the refractory burner block along line 4C-4C shown in FIG. 3.
Figure 4D:
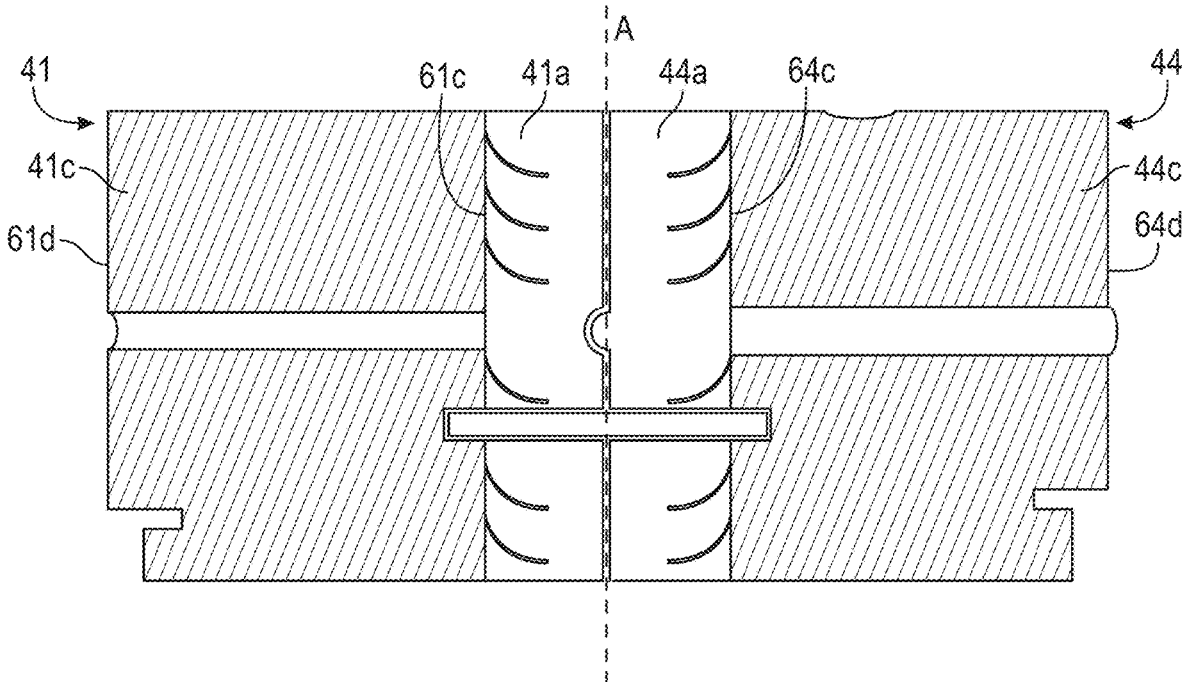
FIG. 4D is a cross-sectional view of the refractory burner block along line 4D-4D shown in FIG. 3.

More specifically, in the embodiment illustrated in FIGS. 1-3, as well as FIGS. 4A-4B, block section 41 includes two mating surfaces 41*b*, 41*c*; block section 42 includes two mating surfaces 42*b*, 42*c*; block section 43 includes two mating surfaces 43*b*, 43*c*; and block section 44 includes two mating sections 44*b*, 44*c*. Furthermore, mating surface 41*b* faces, engages or mates against adjacent mating surface 44*b*; mating surface 41*c* faces, engages or mates against adjacent mating surface 42*c*; mating surface 42*b* faces, engages or mates against adjacent mating surface 43*b*; mating surface 42*c* faces, engages or mates against adjacent mating surface 41*c*; mating surface 43*b* faces, engages or mates against adjacent mating surface 42*b*; mating surface 43*c* faces, engages or mates against adjacent mating surface 44*c*; mating surface 44*b* faces, engages or mates against adjacent mating surface 41*b*; and mating surface 44*c* faces, engages or mates against adjacent mating surface 43*c*. Other shapes and configurations of the burner block 40 and the sections thereof 41-44 are contemplated.

Additionally, in at least one embodiment the mating surfaces of the burner block sections 41-44 include a connection assembly, for example, in the form of corresponding tongues-and-grooves in order to facilitate the mating or interconnection between adjacent mating surfaces and/or the burner block sections 41-44. For example, a first one of the mating surfaces of adjacent block sections includes a tongue or projection, while the other one or the second one of the mating surfaces of adjacent block sections includes a groove, such that, the tongue and the groove connect or mate with one another. In other words, each pair of adjacently disposed mating surfaces (of adjacent block sections) may include a tongue-and-groove connection assembly facilitating the interconnection or mating there between.

As an example, with reference to the embodiment shown in FIGS. 1-3, mating surface 41*b* of section 41 includes a groove 51*b* which corresponds and connects with tongue or projection 54*b* on adjacent mating surface 44*b*; mating surface 41*c* of section 41 includes a groove 51*c* which corresponds and connects with tongue or projection 52*c* on adjacent mating surface 42*c*; mating surface 42*b* of section 42 includes a tongue or projection 52*b* which corresponds and connects with groove 53*b* on adjacent mating surface 43*b*; and mating surface 43*c* of section 43 includes a groove 53*c* which corresponds and connects with tongue or projection 54*c* on adjacent mating surface 44*b*.

Of course, other tongue-and-groove configurations (e.g., the reverse of that described above) as well as other connection assemblies, such as clips, clamps, hooks, loops, etc. is/are also contemplated within the full spirit and scope of the present invention.

Furthermore, in at least one embodiment, the tongues and grooves of the tongue-and-groove connection assembly extend to and between opposing edges of the corresponding mating surface. For example, with reference to FIG. 4A, groove 51*b* on surface 41*b* extends all the way to and between the opposing edges 61*a*, 61*b*. In this example, hole or sight port 90 extends through the block section 41 transverse to the groove 51*b*, but otherwise, the groove 51*b* extends to the opposing edges 61*a*, 61*b* and entirely there between. Further, groove 51*c* extends to opposing edges 61*c*, 61*d* and entirely therebetween. Tongue or projection 52*c* extends to and entirely between edges 62*c*, 62*d*; tongue or projection 52*b* extend to opposing edges 62*a*, 62 and entirely there between; groove 53*b* extends to opposing edges 63*a*, 63*b*, and entirely there between; groove 53*c* extend to opposing edges 63*c*, 63*d* and entirely there between; tongue or projection 54*c* extends to opposing edges 64*c*, 64 and entirely there between; and tongue 54*b* extends to opposing edges 64*a*, 64*b* and entirely there between, although in the example shown, hole or sight port 90 extends transversely across tongue 54*b*.

Moreover, the tongue-and-groove design or connection assembly between adjacent burner block sections 41-44 restricts gas bypassing between each of the block sections 41-44. In other words, the large radius design of the tongue and/or groove allows the surface areas of each block section 41-44 to provide a gas-tight or gas-restricting seal, even in the event the burner tip is firing directly onto a burner block section 41-44 with flame impingement. This sealing effect of the joint between adjacent burner block sections 41-44 restricts, and in some cases eliminates gas bypassing to the shell.

Furthermore, in at least one embodiment, at least one, although in many embodiments, each of the burner block sections 41-44 include an internal groove 71, 72, 73, 74 within which a sealing member 70 is disposed. In some embodiments, for example, as shown in the example of FIGS. 4A and 4B, the grooves 71-74 are orthogonal to or otherwise perpendicular to a burner port axis A. Other orientations are contemplated, however.

In any case, the sealing member 70 of at least one embodiment is a sealing ring that is disposed, seated or sealed within the corresponding grooves 71-74, and encircles, surrounds and in some cases sealingly engages to an external surface of the burner port or firing tube 24. In this manner, the gas sealing ring 70 disposed on or sealingly engaged to the external surface or circumference of the firing tube 24 restricts, and in some cases eliminates gas bypassing between the burner block 40 and the firing tube 24. For instance, the gas sealing ring 70 of at least one embodiment is configured to restrict or eliminate all gas bypassing back to the mounting plate 20.

More specifically, the gas sealing member or ring 70 of at least one embodiment is constructed of a heat-resistant and in some cases rigid or semi-rigid material, such as but in no way limited to stainless steel, although other materials are contemplated such that the gas sealing member 70 operates in the intended fashion to restrict the flow of gas there through during operation of the burner block assembly 10. Moreover, in at least one embodiment, when the burner block 40 or burner block sections 41-44 are set in place, the slot(s) 71-74 within which the sealing ring 70 is seated may be filled with mortar or other like material.

It should also be noted that, simply for purposes of clarity and illustration, the size, dimensions and or thicknesses of the sealing ring 70, as well as other components and features of the various embodiments, shown in the Figures, and in particular, the cut-away views of FIGS. 4A-4D, may not be drawn or shown to scale.

Furthermore, in at least one embodiment, at least one, although in most cases each of the plurality of burner block sections 41-44 includes a groove 81, 82, 83, 84 such as an attachment groove disposed on an external surface or otherwise accessible externally from the burner block 40. The grooves 81-84 or channels are formed to correspondingly receive the clips 32 of the attachment assembly 30 therein. In other words, the angled tips or ends 36 of the clips 32 connect to or are otherwise removably disposed within the corresponding groove(s) 81-84 in order to mount the burner block 40 to the mounting plate 20.

In at least one embodiment, the each of the grooves 81-84 include a recessed lower ledge 81*a*, 82*a*, 83*a*, 84*a* that extends downward from the outer opening of the groove or channel 81-84. More specifically, the lower ledges 81*a*, 82*a*, 83*a*, 84*a* of at least one embodiment is recessed inward from the corresponding outer edges or wall and is, therefore, considered recessed. The ledge or wall 81*a*, 82*a*, 83*a*, 84*a* may be recessed a distance approximately equal to a thickness of the clip arm 34, although other recessed distances, as well as no recess is contemplated.

Furthermore, in at least one embodiment, the external grooves 81, 82, 83, 84, and in some cases, the recessed ledges or walls 81*a*, 82*a*, 83*a*, 84*a* may continuously extend the entire periphery of the burner block 40. In other embodiments, however, the external grooves 81, 82, 83, 84 and/or the recessed ledges or walls 81*a*, 82*a*, 83*a*, 84*a* may be positioned on the burner block 40 and/or the sections 41-44 thereof in order to correspond with the positioning of the clips 32 that extend from the mounting plate 20.

Moreover, the individual mounting tabs or clips 32 of at least one embodiment and the corresponding channels 81-84 allow each of the burner block sections 41-44 to move independently of one another, thereby reducing stress during thermal cycling. In this manner, each of the burner block sections 41-44 are referred to herein as being independent and/or separate.

More specifically, it should also be noted that anchor embedment is often a cause for concern due to the different in thermal expansion coefficients between embedded alloy anchor and the refractory material. As described herein, at least one embodiment uses at least one, although more practically a plurality of attachment clips or tabs 32 that mount into a joint, groove or channel 81-8814 fabricated into the refractory material. This allows the anchoring system, attachment assembly 30 and/or the burner block 40 itself to expand without affecting the integrity of the refractory block 40.

Additionally, the reduction of the mechanical stress on the clips or tabs 32 eliminates breaking or weld cracking failures. The angled tabs 32 also allow the burner block 40 and/or the sections 41-44 thereof to be attached to the shell via a cast slot in the refractory shape. This attachment allows for a tight installation of the block to the shell without the use of bolting or refractory anchors.

Furthermore, in at least one embodiment, and in particular as shown in FIGS. 1-3, the burner block 40 includes four substantially geometrically symmetrical independent block sections 41-44. More specifically, the block sections 41-44 may not be perfectly geometrically symmetrical due to the tongue-and-groove connection assembly described herein and/or the hole or sight port 90 formed through the burner block 40. In any event, the four block sections 41-44 provides a four-quadrant block fabrication. Each block section 41-44 forms an outer corner of the square, rectangular or polygonal shape of the burner block 40, and includes an inner radial wall that collectively forms the burner block aperture 45.

The four-block design of at least one embodiment of the present invention allows for the independent thermal growth of each block section 41-44. In other words, one block section may thermally expand or grow at a different rate or impact than another one of the block sections of the same burner block 40. This reduces internal mechanical stresses and prevents or minimizes cracking of refractory shapes.

In addition, the independent and separate burner block shapes of at least one embodiment of the present invention reduces stress on the attachment assembly 30, that in turn, reduces or eliminate warping of the mounting plate that would then lead to gas bypassing on the carbon steel shell.

Moreover, the geometric symmetry or substantial geometric symmetry of the four block assembly of at least one embodiment allows for a more uniform equilibrium of the entire assembly 10. With each quadrant or block section performing independently and the same as the other block sections, mechanical stresses are not localized, and stresses that may be applied to the firing tube and/or mounting plate are reduced or eliminated.

It should also be noted that with separate and independent block sections, each section 41-44 can be repaired or replaced without having to repair or replace the other section(s). In other words, one section or quadrant can be replaced or repaired without affecting the other block sections or other components of the assembly 10.

Further, the designed refractory materials of construction provide an assembly 10 that allows for controlled expansion while reducing the mounting plate temperature. The assembly 10 provides for mechanical abuse and flame impingement of burner while controlling expansion to reduce mechanical stress on the burner block attachment tabs 32.

Referring again to FIGS. 1 and 2, in at least one embodiment the assembly 10 also includes at least one intermediate plate or insulation layer, such as a first intermediate layer 12 and a second intermediate layer 14 disposed between the mounting plate 20 and the burner block 40. In the example shown, the first and second layers 12, 14 are stacked upon one another, with the first layer engaging or facing the mounting plate 20 and the second layer engaging or facing the burner block 40. In other embodiments, more or less than two intermediate or insulation layers 12, 14 are contemplated. In any event, the one or more intermediate or insulation layers 12, 14 provide one or more layers of insulation or protection that reduces the thermal profile of the hot face temperature across the mounting plate. This reduces or restricts warping of the mounting plate 20 that can otherwise occur if the temperature of mounting plate 20 or the temperature upon which the mounting plate 20 is exposed is too high. In this manner, the one or more layers 12, 14 of at least one embodiment may be constructed of any material configured to facilitate implementation of the present invention in the intended manner, including, for example, heat-resistant materials, rigid board insulation material, or other rigid, semi-rigid or resilient and durable material that is able to withstand the high temperatures of the furnace and environment. Furthermore, in some embodiments, the insulation layer(s) 12, 14 may be approximately one and half inches in thickness each. Thus, in the embodiment with two insulation layers 12, 14, a total of approximately three inches of insulation may be provided. Of course, other embodiments may have more or fewer than two insulation layers, and each insulation layer may have a thickness of more or less than one and a half inches.

Moreover, as shown in FIGS. 1 and 2, for example, the intermediate plates or insulation layers 12, 14 each include center holes or openings 13*a*, 15*a* that correspond with or otherwise receive the burner port 24 therethrough, and which correspond or at least partially align with the burner block aperture 45.

Furthermore, at least one secondary hole 13*b*, 15*b* may also be included to correspond or at least partially align with the sight port 90 formed on the burner block 40.

Moreover, in at least one embodiment, at least one of the intermediate plates or layers, such as the first intermediate plate 12 includes one or more openings, grooves or recesses, referenced as 17*a-c*, which correspond with one or more tabs or projections, referenced as 16*a-c* disposed on the mounting plate 20. In other words, the tabs or projections 16*a-c* on the mounting plate 20 will line up with and connect to the corresponding openings, grooves or recesses 17*a-c* on the intermediate plate 12. This allows the intermediate plate to be properly aligned and mounted to the mounting plate 20.

Furthermore, in at least one embodiment, each of the two layers 12, 14 may be in at least two pieces or sections that are joined at corresponding joint. For example, in the embodiment shown, the first intermediate plate 12 may include at least two, although in this example, four sections referenced as 12*a-d* connected to one another along corresponding joints 12*e-h*. Similarly, the second intermediate plate 14 may also include at least two, although in this example, four sections referenced as 14*a-d* connected to one another along corresponding joints 14*e-h*. In at least one embodiment, when the two plates 12, 14 are stacked upon one another or layered in the manner shown, the at least two joints 12*e-h* on one layer 12 are offset from, or otherwise do not line up with the at least two joints 14*e-h* of the other layer 14. This provides some additional structural integrity to the plates 12, 14 and to the assembly 10 as a whole and also restricts or eliminates any clear through path from the joints within which heat would otherwise pass.

Figure 6:
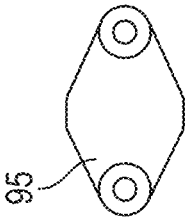
FIG. 6 is a plan view of the sight port cover as disclosed in accordance with at least one embodiment of the present invention.
Figure 7:
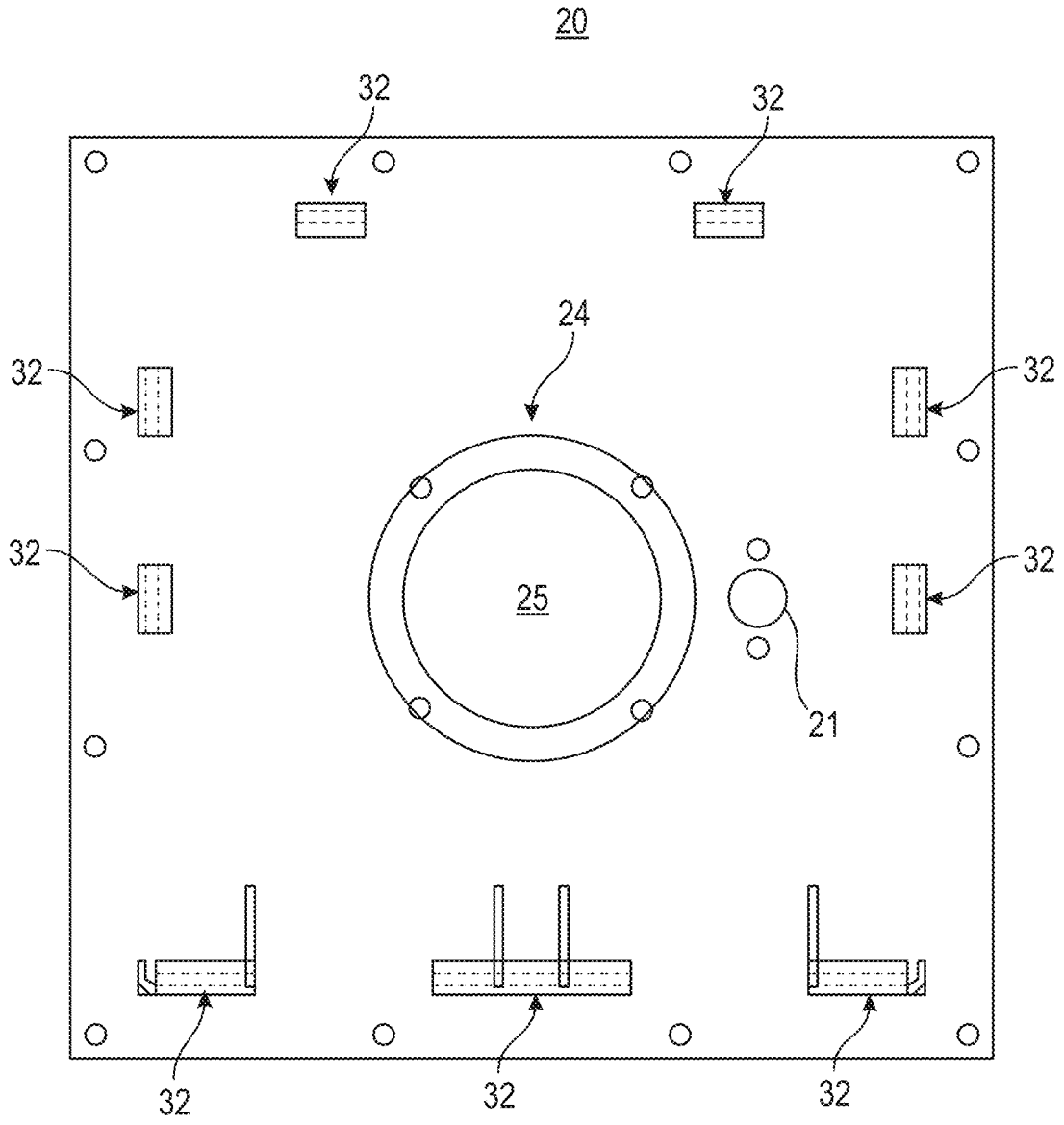
FIG. 7 is a top plan view of the mounting plate as disclosed in accordance with at least one embodiment of the present invention.

FIG. 6 illustrates an exemplary sight port cover 95 mounted to the second surface 22*b* of the mounting plate 20, as shown in FIG. 5, for example, via one or more fasteners (not shown. The sight port cover 95 can be selectively disposed between a closed position and an open position. More specifically, when the sight port cover 95 is disposed in the closed position, the cover 95 obstructs or overlies a sight port that passes through the mounting plate 20 and the burner block 40 via hole 21 (in the mounting plate 20) and hole or sight port 90 (in the burner block 40). In the event one or more intermediate or insulation layers 12, 14 are used, corresponding holes 13*b*, 15*b* also align to collectively form the sight port. In order to open the sight port, the sight port cover 95 can be moved, pivoted, slid or swung into a position that exposes the hole 21 and the remaining sight port. This can be done, in some cases, by loosening or removing one the fasteners that secures the sight port cover 95 in place, although other embodiments allow for other methods of moving the sight port cover 95 into and out of the closed and open position. With the sight port cover 95 in the open position, an operator or user can obtain a visual view from the exterior side of the furnace or from the second side 22*b* of the mounting plate 20 through the insulation layer(s) 12, 14 (if present) and through the burner block 40 in order to view or inspect the flame ignition or burner tip.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

The invention claimed is:

1. A burner block assembly, comprising:

a mounting plate comprising a first surface and a second surface, an attachment assembly fixed to and extending from said first surface of said mounting plate, a burner port extending from said first surface of said mounting plate, a burner block mounted to said mounting plate, said burner block comprising a plurality of independent block sections, each of said plurality of independent block sections comprising an internal surface collectively defining a burner block aperture, said burner block aperture being disposed in a surrounding relation to said burner port, each of said plurality of independent block sections comprising a groove disposed on said internal surface, and an external attachment groove disposed on at least one external surface, a heat-resistant ring disposed with said groove of each of said plurality of independent block sections and extending from said groove to an external surface of said burner port, and wherein said attachment assembly comprises a plurality of clips extending from said first surface of said mounting plate, each of said plurality of clips comprising an arm attached to said mounting plate and an angled projection extending from a distal end of said arm, wherein said angled projection of each of said plurality of clips is disposed within a corresponding one of said external attachment grooves of at least one of said plurality of independent block sections such that each of said plurality of clips attach to at least one of said plurality of independent block sections.

2. The assembly as recited in claim 1 wherein said groove is orthogonal to a burner port axis.

3. The assembly as recited in claim 1 wherein said heat-resistant ring restricts gas bypassing between said burner block and said burner port.

4. The assembly as recited in claim 1 wherein each of said plurality of independent block sections comprise at least one mating surface, wherein said mating surfaces of adjacent ones of said plurality of independent block sections mate against each other.

5. The assembly as recited in claim 4 wherein a first one of said mating surfaces of adjacent ones of said plurality of independent block sections comprises a tongue and wherein a second one of said mating surfaces of adjacent ones of said plurality of independent block sections comprises a groove, wherein said tongue and said groove connect with one another.

6. The assembly as recited in claim 5 wherein said tongue extends to and between opposing edges of said first one of said mating surfaces and said groove extends to and between opposing edges of said second one or said mating surfaces.

7. The assembly as recited in claim 6 wherein said tongue and said groove restrict gas bypassing between said adjacent ones of said plurality of independent block sections.

8. The assembly as recited in claim 1 further comprising at least one insulation layer disposed between said mounting plate and said burner block to reduce a thermal profile on said mounting plate.

9. The assembly as recited in claim 8 wherein said at least one insulation layer comprises a first insulation layer and a second insulation layer, said second insulation layer stacked on top of said first insulation layer, wherein said first insulation layer comprises at least two sections connected to one another at at least one first joint, and wherein said second insulation layer comprises at least two sections connected to one another at at least one second joint, said at least one second joint being offset from said at least one first joint.

* * * * *